United States Patent [19]

Heck et al.

[11] Patent Number: 4,534,669

[45] Date of Patent: Aug. 13, 1985

[54] CLEANING SYSTEM WITH CARTRIDGE HAVING VALVE MEANS

[75] Inventors: Samuel C. Heck; Lee E. Garrison, both of San Antonio, Tex.

[73] Assignee: Sani-Fresh International, Inc., San Antonio, Tex.

[21] Appl. No.: 478,516

[22] Filed: Mar. 24, 1983

[51] Int. Cl.[3] ..... A46B 11/00; A46B 11/02

[52] U.S. Cl. ..... 401/134; 401/135; 401/151; 401/157; 401/146

[58] Field of Search ..... 401/133, 134, 132, 135, 401/146–151, 160, 157, 101

[56] References Cited

U.S. PATENT DOCUMENTS

| | | | |
|---|---|---|---|
| 2,987,743 | 6/1961 | Capps | 401/135 |
| 3,228,057 | 1/1966 | Parrish | 401/133 |
| 3,233,594 | 2/1966 | Zepell | 401/135 X |
| 3,788,753 | 1/1974 | Stewart | 401/134 |
| 3,877,822 | 4/1975 | Lamura | 401/101 |
| 4,217,671 | 8/1980 | Rand | 15/24 |

FOREIGN PATENT DOCUMENTS

| | | | |
|---|---|---|---|
| 0014805 | 12/1979 | European Pat. Off. . | |
| 0052590 | 11/1981 | European Pat. Off. . | |
| 2040496 | 8/1971 | Fed. Rep. of Germany . | |
| 2331694 | 6/1973 | Fed. Rep. of Germany . | |
| 2831205 | 7/1978 | Fed. Rep. of Germany . | |
| 1571383 | 6/1969 | France | 401/134 |
| 633229 | 2/1962 | Italy | 401/134 |

*Primary Examiner*—Steven A. Bratlie

*Attorney, Agent, or Firm*—Gunn, Lee & Jackson

[57] ABSTRACT

A cleaning fluid cartridge, adapted for use with a cleaning system having a handle and a cleaning brush attached thereto, wherein a flexible bag contains the cleaning fluid, and a check valve is sealingly disposed within an opening in the flexible bag.

14 Claims, 7 Drawing Figures

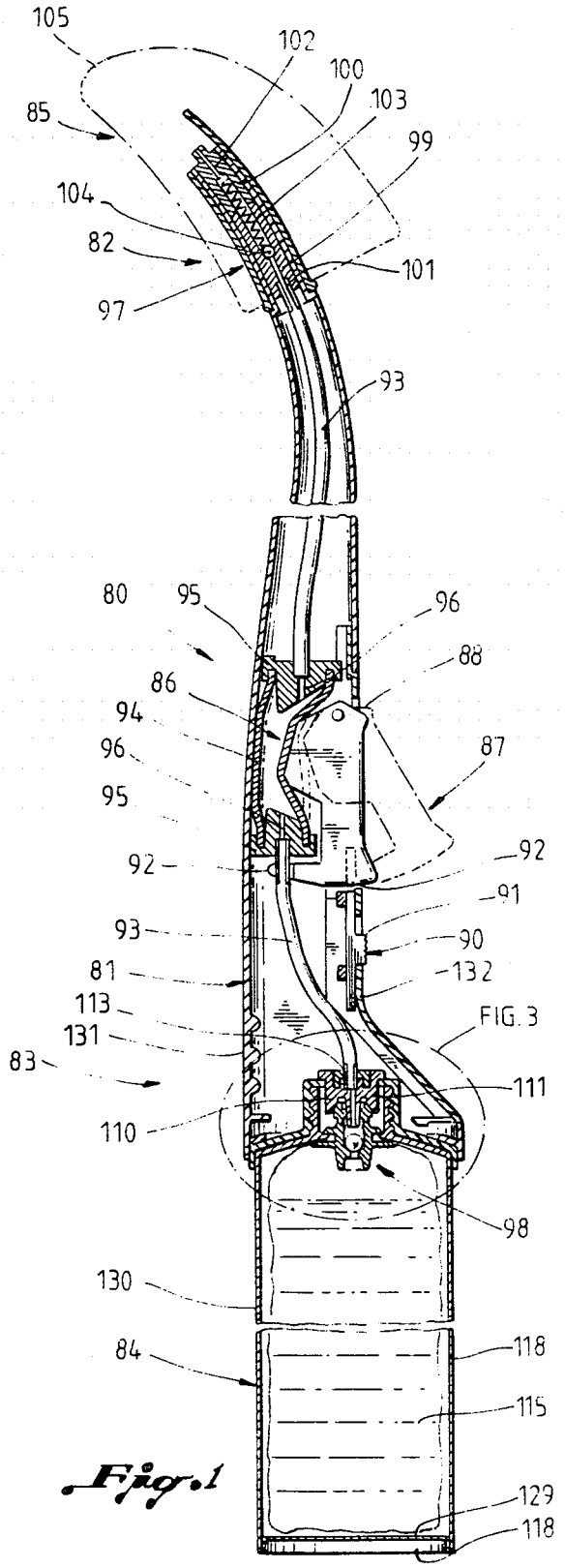
Fig. 1
Fig. 2
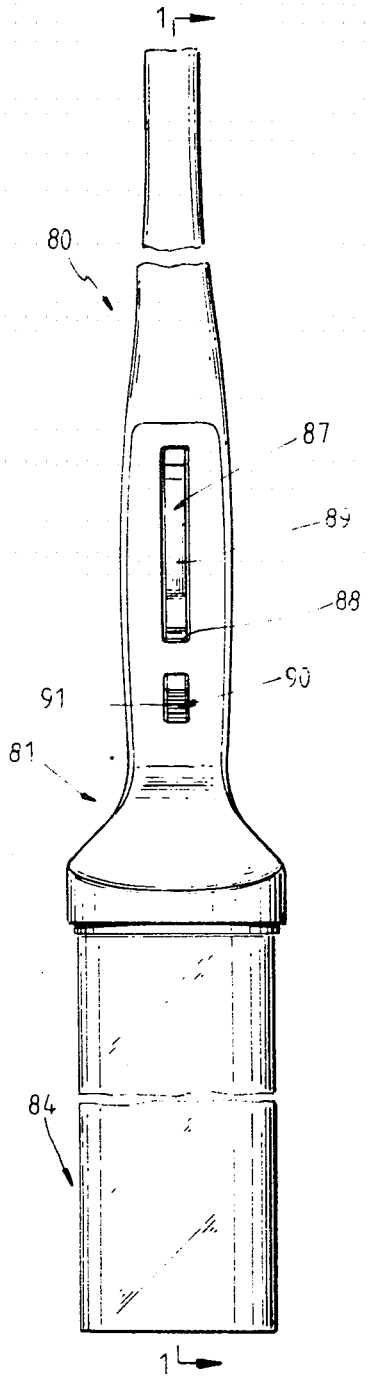

93'
113
114
81
110'
112
123
106
128
111
108
98
121
107
110
83
120
109
119
110"
117
116
124
126
127
122
125
98
98'
118
84
115

Fig. 4
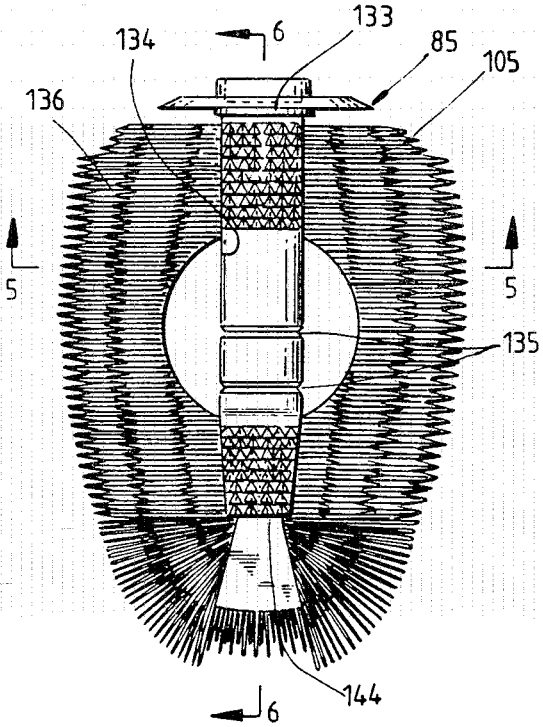
Fig. 6
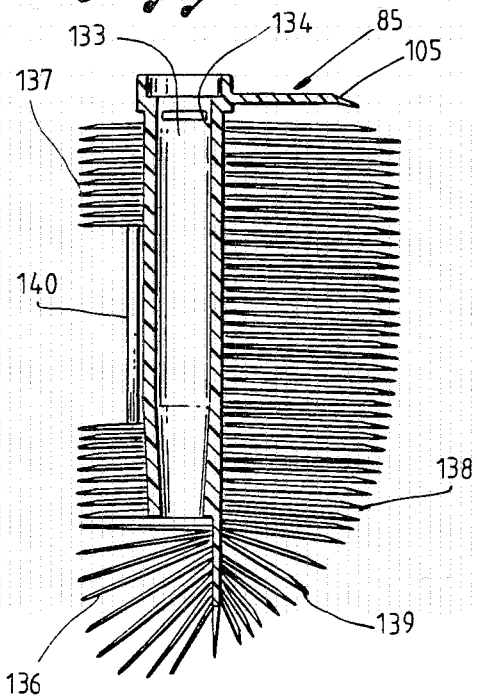
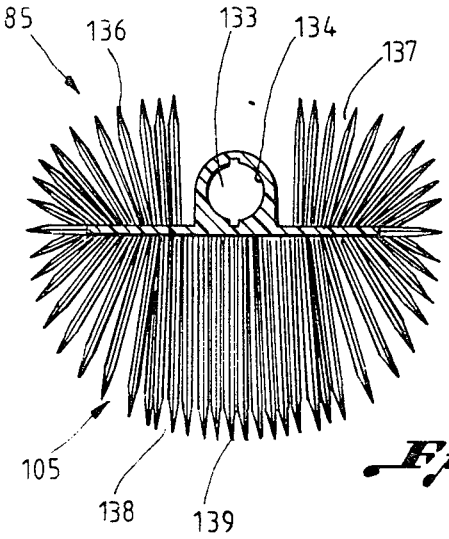
Fig. 5
Fig. 7
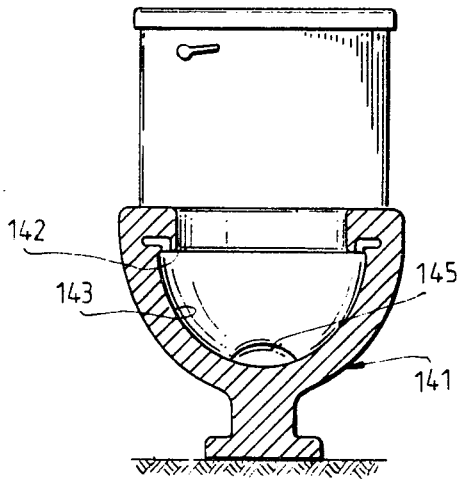

CLEANING SYSTEM WITH CARTRIDGE HAVING VALVE MEANS

FIELD OF THE INVENTION

The invention relates to a cleaning system, particularly for use in cleaning bathrooms and bathroom plumbing fixtures.

DESCRIPTION OF THE PRIOR ART

Typically bathroom fixtures, such as conventional commodes, or water closets, found in the home, or wall-mounted urinals found in such places as commercial building bathrooms, are cleaned with a short handled brush or sponge and a conventional scouring powder contained in a can or with a liquid cleaner which is poured or sprayed from a bottle. Suffice to state that cleaning such plumbing fixtures with the foregoing described brush is an arduous and awkward task.

One attempt to alleviate the inherent problems encountered in cleaning bathroom fixtures is disclosed in U.S. Pat. No. 4,217,671, issued to Rand on Aug. 19, 1980. This patent discloses an electrically powered cleaning device wherein a plurality of different shaped scrubber heads are rotated by an electrical motor, and a gravity operated detergent dispenser is associated with the device. The apparent disadvantages with this cleaning device are that many restrooms may not have an electrical outlet conveniently located with respect to the commode, or water closet, to be cleaned; as well as the inherent, potential danger associated from operating an electrical device, a portion of which is immersed in water. Another, apparent disadvantage would be that the weight of such a device could easily cause muscle strain for the worker utilizing such a device to clean commodes, or water closets, and/or wall mounted urinals. A further apparent disadvantage of this device would appear to be the expense of manufacturing such a device, particularly when an electrical motor must be included therewith. Additionally, there would appear to be another safety hazard in that a strong possibility would exist that detergent could drop onto the rotating brush and be flung into an operator's eye, or alternatively, such material could riccochet from the rotating brush to the bathroom fixture into the operator's eye.

Accordingly, prior to the development of the present invention, there has been no cleaning device or system particularly adapted for cleaning bathroom plumbing fixtures which is simple and economical to manufacture, safe to operate and use, and prevents muscle strain to the operator of the system. Therefore, the art has sought a cleaning system for bathroom plumbing fixtures which is simple and economical to manufacture, is easily and safely used and seeks to eliminate muscle strain and other inherent problems encountered when cleaning bathroom plumbing fixtures.

SUMMARY OF THE INVENTION

In accordance with the invention the foregoing advantages have been achieved through the present cleaning system. The present invention includes an elongate handle having first and second ends and a cleaning fluid cartridge means adapted to contain a cleaning fluid; the handle includes a surface cleaning means disposed at the first end, the cleaning fluid cartridge means being disposed at the second end, a means for pumping the cleaning fluid from the fluid cartridge means to the surface cleaning means, said pump means being disposed within the handle, and a pump actuation means associated with the pump means and the handle. A feature of the present invention is that the cleaning fluid cartridge means may be removeably attached to the handle. A further feature of the present invention is that the surface cleaning means may be a brush disposed on the first end of the handle, the brush including a fluid passageway to allow the cleaning fluid to be pumped through, and outwardly of, the brush to a surface to be cleaned.

An additional feature of the present invention is that the pump means may include a first check valve disposed between the pump actuator means and the surface cleaning means, and the second check valve is disposed between the cleaning fluid cartridge means and the pump actuator means.

Further, in accordance with the present invention, a cleaning device is disclosed having an elongate handle having first and second ends and adapted to receive a cleaning fluid cartridge means containing a cleaning fluid; the handle including a surface cleaning means disposed at the first end, the cleaning fluid cartridge means adapted to be disposed at the second end, a means for pumping the cleaning fluid from the fluid cartridge means to the surface cleaning means, said pump means being disposed within the handle, and a pump actuation means is associated with the pump means and the handle.

The present invention further includes a cleaning fluid cartridge, adapted for use with a cleaning system having a handle and a surface cleaning means disposed on one end thereof. This cleaning fluid cartridge includes a flexible bag, adapted to contain a cleaning fluid, and having an opening therein; and a check valve sealingly disposed within the opening, the valve having a first open operating position which allows cleaning fluid to pass through the valve and a second sealed operating position to prevent egress of cleaning fluid through the valve. A further feature of the cleaning fluid cartridge is that the check valve may have a third sealed non-operating position which allows the cleaning fluid to be stored within the flexible bag. The check valve may have a general tubular configuration having an inlet orifice, an exit orifice, and a sealing member chamber having a sealing member disposed therein, the inlet orifice having a sealing surface associated therewith which cooperates with the sealing member to provide the second sealed operating position. A further feature of the cleaning fluid cartridge is that the sealing member may be a ball which is moveable within the sealing member chamber, wherein the sealed non-operating position has the ball initially disposed within a reduced diameter portion of the exit orifice and the ball is resiliently secured therein.

The present invention further includes a connector assembly, for use with a cleaning fluid cartridge and a cleaning system having a handle with first and second ends and a surface cleaning means disposed on the first end thereof. This connector assembly includes an elongate piercing member adapted to be mounted on the second end of the handle; a check valve having a general tubular configuration adapted to be mounted on the cleaning fluid cartridge; the check valve having an inlet orifice, an exit orifice with a reduced diameter portion, and a sealing chamber therebetween; mating and cooperating engagement means adapted to be disposed on the cleaning fluid cartridge and on the handle; and a sealing member resiliently secured within the exit orifice in a sealed non-operating position and, upon the piercing member entering the check valve and the mating of the engagement means, the sealing member is forced into the sealing member chamber to be disposed in either a sealed operating position or open operating position within the sealing member chamber.

The present invention further includes a cleaning system, having an elongate handle with first and second ends with a surface cleaning means disposed at the first end and a cleaning fluid cartridge means disposed at the second end, wherein the cleaning fluid cartridge means is mounted to the handle with the outer upper surface of the cleaning fluid cartridge means being substantially parallel and coplanar with the outer upper surface of the handle. A further feature of this cleaning system is that the longitudinal axis of the cleaning fluid cartridge means may be disposed substantially parallel to the longitudinal axis of the handle and said axis is disposed substantially parallel to the lower outer surface of the handle. An additional feature of this cleaning system is that the surface cleaning means may comprise a brush having a central passageway which resiliently engages the first end of the handle, the passageway having walls which include means for allowing the brush to conform to the outer configuration of the first end of the handle. A further feature of this cleaning system is that the surface cleaning means may be a brush having a first set of bristles forming the upper surface of the brush, the ends of said bristles forming a substantially horizontal planar scrubbing surface, and a second set of bristles forming the lower surface of the brush, the ends of said second set of bristles forming a curved scrubbing surface.

The cleaning system of the present invention, when compared with previously proposed prior art cleaning devices has the advantages of being simple and economical to manufacture and use, is safe to manufacture and use (when properly used), and helps to prevent and/or alleviate muscle strain associated with the cleaning of bathroom plumbing fixtures.

BRIEF DESCRIPTION OF THE DRAWINGS

In the drawings:

FIG. 1 is a partial cross-sectional view along the longitudinal axis of a cleaning system in accordance with the present invention;

FIG. 2 is a partial top view of the cleaning system of the present invention;

FIG. 4 is a top view of a surface cleaning means in accordance with the present invention;

FIG. 5 is a cross-sectional view taken along line 5—5 of FIG. 4;

FIG. 6 is a cross-sectional view taken along line 6—6 of FIG. 4; and FIG. 7 is a partial cross-sectional view of a conventional commode, or water closet.

Figure 3:
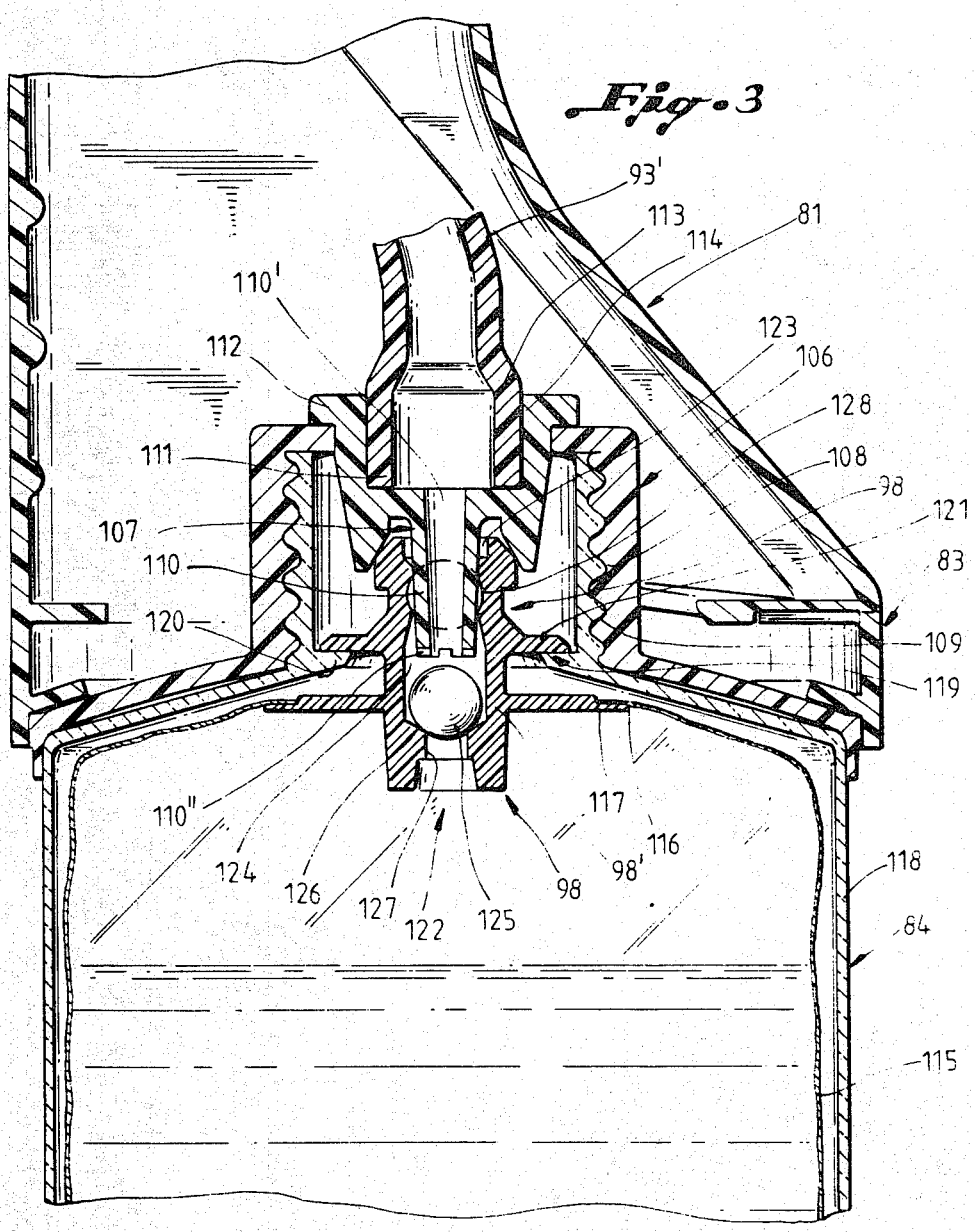
FIG. 3 is an exploded cross-sectional view of the portion of FIG. 1 appearing within the dotted lines marked FIG. 3.

While the invention will be described in connection with the preferred embodiment, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE INVENTION

In FIGS. 1 and 2, a cleaning system 80 in accordance with the present invention is shown to generally comprise an elongate handle 81 having first and second ends, 82 and 83 and a cleaning fluid cartridge means 84 adapted to contain a cleaning fluid, as will be hereinafter described. Handle 81 preferably includes a surface cleaning means 85 at the first end 82 of handle 81, which surface cleaning means 85 will be hereinafter described in greater detail. The cleaning fluid cartridge means 84 is disposed at the second end 83 of handle 81. Handle 81 further preferably includes a means for pumping 86 the cleaning fluid from the fluid cartridge means 84 to the surface cleaning means 85, and the pump means 86 is disposed within the handle 81. Further, the handle 81 preferably includes a pump actuation means 87 associated with the pump means 86 and the handle 81.

Further with reference to FIGS. 1 and 2, it is seen that handle 81 is provided with an opening 88 through which the pump actuator means 87 passes. Pump actuator means 87 preferably comprises a moveable member, or trigger member, 89 which engages pump means 86, and the moveable member 89 is disposed intermediate the first and second ends 82 and 83 of handle 81. Handle 81 may include a means for releaseably securing 90 the moveable member 89 in an inoperative position to preclude pumping of the cleaning fluid from the cleaning fluid cartridge means 84. Preferably, the releasable securing means 90 is a slideable safety switch 91 supported within handle 81 in any suitable manner, which may be slid into engagement with the underside of moveable member, or trigger, 89. As seen in FIG. 1, moveable member or trigger, 89 is shown in solid lines when it is in engagement with pump means 86 in a fluid pumping mode, and trigger 89 is shown in dotted lines in its non-pumping position. Further, safety slide 91 is shown in dotted lines in its safety position when it has been slid to prevent the underside 92 of moveable member 89 from moving inwardly into handle 81. Preferably, pump means 86 is a fluid passageway 93 extending from the cleaning fluid cartridge means 84 to the surface cleaning means 85, and the fluid passageway 93 is disposed within elongate handle 81. Pump means 86 further includes an enlarged cross-sectional area portion 94 which is disposed proximate the pump actuation means 87. As shown in FIG. 1, the enlarged cross-sectional area portion 94 of the pump means 86 is a tubular member disposed between two end pieces 95 which are secured within handle 81. Each end piece 95 has an axial opening 96 formed therein which is in fluid transmitting relationship to the interior of the enlarged cross-sectional area portion 94 and the fluid passageway 93. Fluid pasageway 93 and enlarged cross-sectional area portion 94 are preferably made from any suitable flexible plastic material having the requisite strength characteristics and ability to withstand contact with the cleaning fluid which will be hereinafter described. Alternatively, fluid passageway 93, including the enlarged cross-sectional area portion 94, may be formed as a unitary structure of latex rubber which has been dipmolded so that the enlarged cross-sectional area portion 94 is formed integral with fluid passageway 93. In this embodiment, end pieces 95 are not necessary.

The foregoing major components of the cleaning system 80, such as elongate handle 81, pump actuator 87, as well as the safety slide switch 91, may be manufactured of any suitable material in any conventional manner, so long as such components have the requisite strength characteristics to enable cleaning system 80 to perform its intended use. Preferably, the foregoing components are molded of a suitable plastic material in any conventional manner.

Still with reference to FIG. 1, pump means 86 further includes a first check valve 97 disposed between the pump actuator means 87 and the surface cleaning means 85, and a second check valve 98 disposed between the cleaning fluid cartridge means 84 and the pump actuator means 87. As will be hereinafter described in detail in connection with FIG. 3, the second check valve 98 may be associated with the cleaning fluid cartridge means 84, or alternatively, may be disposed within handle 81. As seen in FIG. 1, the first check valve 97 is disposed proximate the first end 82 of handle 81.

With reference to FIG. 1, the first check valve 97 will be described in greater detail. First check valve 97 preferably includes a check valve housing formed in two parts 99 and 100. Housing 99 and 100 has a fluid passageway 101 in fluid transmitting relationship with the tubing or fluid passageway 93. Likewise, there is a fluid passageway exit orifice 102 formed in housing portion 100. A spring 103 is disposed within check valve housing 99 and 100, which spring 103 biases a ball 104 toward the enlarged cross-sectional area portion 94 of pump means 86. Accordingly, ball 104 is normally in a sealed, seated position to fluid passageway 101 of check valve housing 99. As will be hereinafter described, surface cleaning means 85 may preferably be a brush 105 disposed on the first end 82 of handle 81 and the brush 105 will include a fluid passageway, to be hereinafter described, to allow the cleaning fluid to be pumped through, and outwardly of, the brush 105, to a surface (not shown) to be cleaned. This fluid passageway would be in alignment with the exit orifice 102 from ball check valve housing 99, 100.

With reference now to FIGS. 1 and 3, further details of cleaning system 80, including the cleaning fluid cartridge means 84 and second check valve 98 will be described in greater detail. Preferably, the cleaning fluid cartridge means 84 is removeably attached to handle 81. Preferably, the second end 83 of elongate handle 81 includes means for releasably engaging 106 the cleaning fluid cartridge means 84 and further includes a means for opening 107 the cleaning fluid cartridge means 84 to form a fluid passageway from the cleaning fluid cartridge means 84 to the pump means 86. Preferably, the engaging means 106 is a threaded connection 108 which is adapted to mate and cooperate with the cleaning fluid cartridge means 84 which may be provided with a mating set of exterior threads 109. It should be readily apparent to one of ordinary skill in the art that although handle 81 is shown to have a female threaded connection means 108 which engages with the external threads 109 of cleaning fluid cartridge means 84, handle 81 could be provided with male threads which mate and cooperate with female threads formed in association with cleaning fluid cartridge means 84. Furthermore, it should be readily apparent that other types of engagement means could be utilized, such as a snap fitting of cleaning fluid cartridge means 84 into elongate handle 81.

The means for opening 107 the cleaning fluid cartridge means 84 may preferably be an elongate piercing member 110 adapted to pierce the cleaning fluid cartridge means 84, which will be hereinafter described in greater detail. Piercing member 110 can be formed integral with a generally tubular shaped member 111 having an outwardly extended rim member 112 which may be secured in any suitable manner, such as by gluing to the upper end of engagement means 106. In this regard, it should be noted that tubular member 111 shown in FIG. 1 has a slightly different configuration from tubular member 111 shown in FIG. 3 in that in FIG. 1, the fluid passageway or tube 93 has the same cross-sectional configuration throughout, whereby it is received into a mating recess 113 formed at the top of tubular member 111 and is held in place in a conventional manner such as by gluing. In contrast, the tubular member 111 of FIG. 3 is used with a fluid passageway, or tube, 93' which has an enlarged end portion 113, which in turn is connected to the recess 114 of tubular member 111 in a conventional manner, such as by gluing. Piercing member 110 has an axial passageway 110' formed therein, and the end of this passageway 110' is provided with grooves 110'' to allow cleaning fluid to pass therethrough.

Still with reference to FIGS. 1 and 3, cleaning fluid cartridge means 84 will be described in greater detail. Preferably, cleaning fluid cartridge means 84 includes a flexible bag 115 and contains a suitable cleaning fluid (not shown) to be hereinafter described. Flexible bag 115 has an opening 116 therein, and a check valve or second check valve 98 is sealingly disposed within the opening 116. Flexible bag 115 may be manufactured of any suitable plastic material having the requisite strength characteristics and ability to withstand contact with the cleaning fluid. In this regard, a typical cleaning fluid useful for cleaning bathroom plumbing fixtures would contain phosphoric acid or other types of acid. Accordingly, flexible bag 115 should preferably be made of a material which is acid-resistant. Check valve 98 can be sealingly disposed within opening 116 of flexible bag 115 as by an acid resistant glue or the portion of flexible bag 115 at opening 116 may be heat sealed in any suitable manner to a lower outwardly extending circular flange member 117 formed on check valve 98. Cleaning fluid cartridge means 84 may further include a housing means 118 which surrounds and protects the flexible bag 115. Preferably, housing means 118 includes a means for supporting 119 the check valve 98 within housing means 118. Preferably, the means for supporting 119 comprises a circularly shaped internal flange 120 which is formed integral with the male threads 109 of cleaning fluid cartridge means 84. Check valve 98 has a second circular shaped outwardly extending flange member 121 which rests upon internal flange 120 which may be secured thereto in any suitable fashion, such as by gluing or heat sealing. Alternatively, check valve 98 may be supported within housing means 118 as by a snap-fit connection.

Still with reference to FIG. 3, it is seen that check valve 98 has a general tubular configuration portion 98' having an inlet orifice 122, an exit orifice 123 and a sealing member chamber 124 having a sealing member 125 disposed within sealing member chamber 124. Further, the inlet orifice 122 has a sealing surface 126 associated therewith which cooperates with the sealing member 125. Preferably, sealing member 125 is a ball which is freely moveable within the sealing member chamber 124. Preferably, as seen in FIG. 3, the inlet orifice 122 has a reduced diameter portion 127.

In manufacturing and filling cleaning fluid cartridge means 84, check valve 98 would be secured to the flexible bag 115 prior to check valve 98 being secured to housing means 118 as previously described. It would then be necessary to fill flexible bag 115 with the desired cleaning fluid. This can readily be accomplished by two methods. In the first method, ball member 125 is disposed within a reduced diameter portion 128 of exit orifice 123 as shown in dotted lines in FIG. 3, whereby the ball 125 is resiliently and sealingly secured therein. This resilient sealing engagement is obtained by having at least a portion of the check valve 98 formed of a resilient plastic material. Alternatively, ball member 125 can be made of a rigid material and the general tubular portion 98' of the check valve 98 can be made of a flexible plastic material. Alternatively, the tubular configuration portion 98' of check valve 98 could be made of a rigid material and the ball member 125 could be made of a flexible material so as to be resiliently and sealingly secured within the reduced diameter portion 128 of exit orifice 123. Preferably, the tubular configuration portion 98' of check valve 98 is made of a resilient plastic material and ball member 125 is made of a rigid material such as glass. Thus, as shown in dotted lines in FIG. 3, exit orifice 123 of check valve 98 is sealed by ball member 125 in a sealed non-operating position. Flexible bag 115 may then be filled from its bottom 129 (FIG. 1) and bottom 129 may then be sealed in a suitable manner such as by gluing or heat sealing. Housing 118 may then be provided with a bottom member 118' which may be glued or heat sealed into place as shown in FIG. 1.

Preferably, flexible bag 115 is connected to check valve 98 and flexible bag 115 and check valve 98 are disposed within housing 118; however, ball member 125 is not inserted into the position shown in dotted lines in FIG. 3 until after flexible bag 115 has been filled with cleaning fluid through the completely opened check valve 98. After flexible bag 115 has been filled, ball member 125 may be forced into the exit orifice 123 into the sealed non-operating position shown in dotted lines in FIG. 3 whereby the cleaning fluid may be stored within the flexible bag 115. Additionally, a conventional bottle cap (not shown) may be threaded about the external threads 109 of housing means 118 to further prevent any leakage of the acidic cleaning fluid material contained within flexible bag 115.

Thus, when it is desired to releaseably attach a cleaning fluid cartridge means 84 to the cleaning device handle 81, the bottle cap is unthreaded from the housing means 118 and cleaning fluid cartridge means 84 is screwed into the second end 83 of handle 81. As the cleaning fluid cartridge means 84 is threaded into handle 81, elongate piercing member 110, fixedly secured to handle 81, presses downwardly upon ball member 125 to force it out of the sealed, non-operating position shown in dotted lines in FIG. 3 until ball member 125 is freely moveable within sealing member chamber 124. At this point in time, ball member 125 may assume either two positions. The first of which is an open operating position, which allows cleaning fluid to pass through the check valve 98. The second sealed operating position prevents egress of cleaning fluid through the valve. In FIG. 3, ball member 125 is shown in the second sealed operating position in that it is abutting the sealing surface 126 of inlet orifice 122. The first open operating position would occur when ball member 125 is spaced from the sealing surface 126 and is either freely supported within sealing member chamber 124, or is abutting the lower end of elongate piercing member 110. The movement of pump actuation means 87, as will be hereinafter described, determines which operating position ball member 125 assumes. It should be noted that were second check valve 98 to be associated with handle 81 and not cleaning fluid cartridge means 84, it would be merely necessary to have some closure member at the top of flexible bag 115, which closure member would be pierced by elongate piercing member 110 so as to create a fluid passageway between flexible bag 115 and fluid passageway 93' via the axial passageway 110' of elongate piercing member 110.

With reference now to FIGS. 1 and 3, the operation of cleaning system 80 will be described in greater detail. With safety slide member 91 in the open operating position illustrated in solid lines in FIG. 1, moveable member 89 would be in the position shown in dotted lines in FIG. 1 and the enlarged cross-sectional area portion 94 of pump means 86 would likewise be in the position shown in dotted lines in FIG. 1. At the same time ball member 104 in first check valve 97 would be biased into its sealed position against fluid passageway 101 in check valve housing 99 and 100, thus preventing any cleaning fluid from being expelled from the first end 82 of handle 81. Upon depressing moveable member, or trigger, 89 into engagement with the enlarged cross-sectional portion 94 of pump 86 into the position shown in solid lines in FIG. 1, the pressure developed forces ball member 125 into the sealed operating position shown in solid lines in FIG. 3. At the same time the pressure developed forces the spring biased ball member 104 out of its sealed position whereby cleaning fluid is expelled outwardly from the first end 82 of handle 81. Upon releasing the trigger member 89, a partial vacuum is created by the expansion of the enlarged portion 94 of pump means 86 as it and the trigger member 89 assume their positions shown in dotted lines in FIG. 1. This vacuum pulls ball member 125 in check valve 98 toward its first open operating position wherein it abuts the lower end of elongate piercing member 110 and the vacuum sucks cleaning fluid through check valve 98 into the fluid passageway 93 and enlarged cross- sectional area portion 94 of pump means 86. This same vacuum, along with spring 103, draws ball 104 of check valve 97 into its sealed position shown in FIG. 1, whereby pump means 86 is primed for the next pumping action which is initiated by depressing moveable member, or trigger, 89. It should be noted that as the cleaning fluid is sucked from flexible bag 115 and is expelled from the first end 82 of handle 81 that at least some of the interior surfaces of the flexible bag 115 will contact one another upon the cleaning fluid being discharged through the check valve 98. It should be noted that insofar as pump means 86 will draw out and expel any air contained within flexible bag 115 and since the flexible bag 115 will collapse upon itself as the cleaning fluid is discharged through check valve 98, the operation of the cleaning system 80 of the present invention is not dependent upon gravity for its operation. Thus, regardless of the disposition of the surface to be cleaned with the cleaning system 80, including brush 105, cleaning fluid may be discharged through the first end 82 of handle 81 and through the brush 105, whereby the surface to be cleaned may be scrubbed with brush 105. In other words, cleaning system 80 may be utilized to clean and scrub vertical surfaces or horizontal surfaces disposed above or below the operator of the system, and the desired cleaning fluid will be expelled from the cleaning system merely by depressing the moveable member, or trigger 89. In this regard, it should be pointed out that cleaning system 80 should be utilized in a safe and proper manner and should not be aimed at anything but inanimate objects because of the potentially acidic nature of the cleaning fluid utilized therein.

Still with reference to FIG. 1 it should be noted that the cleaning fluid cartridge means 84 is mounted to the handle 81 with the outer upper surface 130 of the cleaning fluid cartridge means being substantially parallel and coplanar with the outer upper surface 131 of the handle 81. It has been found that this particular configuration enhances the ease with which the cleaning system 80 may be utilized by its operator, and constitutes an important feature of the present invention. Furthermore, the longitudinal axis of the cleaning fluid cartridge means 84 is disposed substantially parallel to the longitudinal axis of the handle 81 and the longitudinal axis of the cleaning fluid cartridge means is disposed substantially parallel to the lower outer surface 131 of the handle 81. This configuration likewise contributes to the enhanced ease of use of the cleaning system 80 of the present invention.

Still with reference to FIG. 1, it is seen that the longitudinal axis of the first end 82 of the handle 81 is disposed at an acute angle to the longitudinal axis of the handle 81. Such acute angle varies whereby the first end 82 of handle 81 curves upwardly away from the upper surface 131 of the handle 81, whereby the surface cleaning means 85 likewise curves upwardly away from the upper surface of the handle. As will be hereinafter described, this configuration along with the design of the cleaning surface means 85, to be hereinafter described, readily lends itself to the cleaning of bathroom plumbing fixtures.

With reference now to FIGS. 4, 5 and 6, one embodiment of a surface cleaning means 85 is disclosed. As seen in FIGS. 4–6 the surface cleaning means 85 is a brush 105 having a central passageway 133 which resiliently engages the first end 82 of handle 81 as seen in FIG. 1. Passageway 133 has a wall surface 134 which includes means for allowing the brush 105 to conform to the outer configuration of the first end 82 of the handle 81. Such means for allowing the brush to conform as desired may preferably comprise a plurality of reduced diameter portions 135 formed on the exterior of passageway 133, which reduced diameter portions 135 allows the exterior wall surface of passageway 133 to flex. Alternatively, slots (not shown) may be spaced along the length of wall surface 134 of passageway 133 to provide the requisite flexibility. The upwardly curving configuration of the brush 105, shown generally in FIG. 1 is particularly suited for the cleaning of bathroom commodes, or water closets, as will be hereinafter described. Brush 105 may preferably have a first set of bristles 136 forming the upper surface of the brush 105, with the ends of said bristles 136 forming a substantially horizontal planar scrubbing surface 137. Brush 105 may preferably further include a second set of bristles 138 forming the lower surface of the brush 105. The ends of said second set of bristles 138 form a curved scrubbing surface 139 when viewed from the side as in FIG. 6 and from the end of the brush 105 as shown in FIG. 5. The first set of bristles 136 may be shorter in length than the second set of bristles 138 as seen in FIGS. 4–6. Brush 105 may further include a mirror 140 disposed on the horizontal planar scrubbing surface 137 which mirror 140 allows an operator to see a reflected view of the surface to be cleaned. In this regard, a conventional bathroom commode, or water closet 141 is shown in FIG. 7. As is conventional with such commodes 141, there is normally an inwardly extending rim 142 which surrounds the bowl portion 143 of commode 141. For sanitary reasons, it is important that the underside of this rim 142 be kept clean; however, it should be readily apparent as to how difficult it is to view the underside of such rim. Accordingly, when brush 105 in connection with cleaning system 80 is used to scrub the underside of rim 142, with the upper scrubbing surface 137, an operator can inspect the underside of the rim 142 via use of the mirror 140.

With reference to FIG. 4, it is seen that surface cleaning means 85 or brush 105, includes an exit port 144 which is disposed between some of the bristles in the first set of bristles 136 whereby cleaning fluid may be expelled from the first end 82 of handle 81 which is in resilient engagement with the interior wall of passageway 133 of brush 105.

It should be noted that the curved surfaces 139 of brush 105 are particularly adapted for cleaning the drain exit 145 of commode 141 as well as the curved surfaces of bowl portion 143 of commode 141.

It is to be understood that the invention is not limited to the exact details of construction, operation, exact materials or embodiment shown and described, as obvious modifications and equivalents will be apparent to one skilled in the art; for example, a spring, outwardly biased button could be utilized for the pump actuation means rather than a pivotable, trigger member. Accordingly, the invention is therefore to be limited only by the scope of the appended claims.

We claim:

1. A cleaning fluid cartridge, adapted for use with a cleaning system having a handle with a piercing member disposed on one end thereof and a surface cleaning means disposed on the other end thereof, comprising:

a flexible bag, adapted to contain a cleaning fluid, and having an opening therein; and a check valve sealingly disposed within said opening, said valve having: an inlet orifice; an exit orifice; a sealing chamber therebetween; a sealing member moveable within said sealing chamber; a first open operating position which allows said cleaning fluid to pass through said valve; a second sealed operating position to prevent egress of said cleaning fluid through said valve; a third sealed non-operating position which allows said cleaning fluid to be stored within said flexible bag;

said bag and said valve cooperating with said piercing member to move said sealing member from said third sealed non-operating position into said sealing chamber to be disposed in either said sealed operating position or said open operating position within said sealing chamber when said cleaning system is operatively engaged with said cartridge.

2. The cleaning fluid cartridge of claim 1 further including: a housing means for surrounding and protecting said flexible bag, said housing including means for supporting said check valve.

3. The cleaning fluid cartridge of claim 1 wherein said check valve has a general tubular configuration having an inlet orifice, an exit orifice, and a sealing member chamber having said sealing member disposed therein, said inlet orifice having a sealing surface associated therewith which cooperates with said sealing member to provide said second sealed operating position.

4. The cleaning fluid cartridge of claim 3 wherein the sealing member is a ball which is moveable within said sealing member chamber.

5. The cleaning fluid cartridge of claim 4 wherein said inlet and exit orifices have a reduced diameter portion.

6. The cleaning fluid cartridge of claim 5 wherein said sealed non-operating position has said ball initially disposed within said reduced diameter portion of said exit orifice and said ball is resiliently and sealingly secured therein.

7. The cleaning fluid cartridge of claim 3 wherein at least a portion of said check valve is formed of a resilient plastic material.

8. The cleaning fluid cartridge of claim 1 wherein at least some of the interior surfaces of said flexible bag contact one another upon said cleaning fluid being discharged through said check valve.

9. A connector assembly, for use with a cleaning fluid cartridge and a cleaning system having a handle with first and second ends and a surface cleaning means disposed on said first end thereof, comprising:

an elongate piercing member adapted to be mounted on said second end of said handle; a check valve having a general tubular configuration adapted to be mounted on said cleaning fluid cartridge;

said check valve having an inlet orifice, an exit orifice with a reduced diameter portion, and a sealing chamber therebetween;

mating and cooperating engagement means adapted to be disposed on the cleaning fluid cartridge and on said handle; and a sealing member resiliently secured within said exit orifice in a sealed non-operating position and, upon said piercing member entering said check valve and said mating of said engagement means, said sealing member is forced into said sealing member chamber to be disposed in either a sealed operating position or open operating position within said sealing member chamber.

10. The connector assembly of claim 9 wherein said sealing member is a ball which is moveable within said sealing member chamber.

11. The connector assembly of claim 9 wherein at least a portion of said check valve is formed of a resilient plastic material.

12. The connector assembly of claim 9 wherein said piercing member and said check valve each have at least one mating sealing surface to form a fluid tight connection therebetween.

13. The connector assembly of claim 12 wherein said at least one mating sealing surface comprises a depending beveled flange sealing surface on said piercing member which mates with a beveled flange disposed on the exterior of said exit orifice of the check valve.

14. The connector assembly of claim 12 wherein said at least one mating sealing surface comprises tapered exterior surface of said piercing member which enters and engages said reduced diameter portion of said exit orifice of said check valve.

* * * * *